US010224132B2

(12) United States Patent
Matsumoto

(10) Patent No.: US 10,224,132 B2
(45) Date of Patent: Mar. 5, 2019

(54) CHIP RESISTOR AND METHOD FOR MANUFACTURING SAME

(71) Applicant: KOA Corporation, Ina-shi, Nagano (JP)

(72) Inventor: Kentaro Matsumoto, Ina (JP)

(73) Assignee: KOA Corporation, Ina-shi (JP)

( * ) Notice: Subject to any disclaimer, the term of this patent is extended or adjusted under 35 U.S.C. 154(b) by 130 days.

(21) Appl. No.: 15/126,199

(22) PCT Filed: Mar. 11, 2015

(86) PCT No.: PCT/JP2015/057170
§ 371 (c)(1),
(2) Date: Sep. 14, 2016

(87) PCT Pub. No.: WO2015/141539
PCT Pub. Date: Sep. 24, 2015

(65) Prior Publication Data

US 2017/0084364 A1 Mar. 23, 2017

(30) Foreign Application Priority Data

Mar. 19, 2014 (JP) ..... 2014-055874

(51) Int. Cl.
*H01C 1/148* (2006.01)
*H01C 17/242* (2006.01)
(Continued)

(52) U.S. Cl.
CPC ..... *H01C 1/148* (2013.01); *H01C 1/012* (2013.01); *H01C 1/12* (2013.01); *H01C 1/14* (2013.01);
(Continued)

(58) Field of Classification Search
CPC ..... H01C 1/148; H01C 1/012; H01C 1/12; H01C 1/14
(Continued)

(56) References Cited

U.S. PATENT DOCUMENTS 6,144,287 A * 11/2000 Komeda ..... H01C 7/00 29/620
7,982,582 B2 7/2011 Belman et al.
(Continued)

FOREIGN PATENT DOCUMENTS

JP 2002-064003 * 8/2000 ..... H01C 7/00
JP 2002-64003 A 2/2002
(Continued)

OTHER PUBLICATIONS

International Search Report (PCT/ISA/210) issued in PCT Application No. PCT/JP2015/057170 dated May 26, 2015, with English translation (four (4) pages).

*Primary Examiner* — Kyung S Lee
*Assistant Examiner* — Iman Malakooti
(74) *Attorney, Agent, or Firm* — Crowell & Moring LLP

(57) ABSTRACT

A chip resistor including an insulating film covering a resistor making contact with a pair of electrodes formed on an upper surface of an insulating substrate and a method for manufacturing same are provided. Both electrodes include a main electrode layer that contains silver as a main metal component an 10 weight % or more of palladium as another metal component, and an auxiliary electrode layer lower in specific resistance than the main electrode layer, a laminate part where the auxiliary electrode layer and the main electrode layer are laminated in order on a single surface of the insulating substrate; and an exposed part of the auxiliary electrode layer where a part of the auxiliary electrode layer is not covered with the main electrode layer on a far side
(Continued)

from the resistor, and part that extend from a near side to the far side with respect to the resistor.

4 Claims, 3 Drawing Sheets

(51) Int. Cl.

| | |
|---|---|
| ***H01C 1/12*** | (2006.01) |
| ***H01C 1/14*** | (2006.01) |
| ***H01C 17/00*** | (2006.01) |
| ***H01C 7/00*** | (2006.01) |
| ***H01C 17/06*** | (2006.01) |
| ***H01C 1/012*** | (2006.01) |

(52) U.S. Cl.
CPC ..... *H01C 7/00* (2013.01); *H01C 17/006* (2013.01); *H01C 17/06* (2013.01); *H01C 17/242* (2013.01)

(58) Field of Classification Search
USPC ..... 338/313
See application file for complete search history.

(56) References Cited

U.S. PATENT DOCUMENTS

| | | | |
|---|---|---|---|
| 2008/0211619 | A1 | 9/2008 | Belman et al. |
| 2012/0126934 | A1 | 5/2012 | Belman et al. |
| 2013/0335191 | A1 | 12/2013 | Belman et al. |

FOREIGN PATENT DOCUMENTS

| | | | |
|---|---|---|---|
| JP | 2008-300607 | A | 12/2008 |
| JP | 2010-520624 | A | 6/2010 |
| JP | 2013-165112 | A | 8/2013 |
| JP | 2013-258292 | A | 12/2013 |

* cited by examiner

CHIP RESISTOR AND METHOD FOR MANUFACTURING SAME

TECHNICAL FIELD

The present invention relates to a chip resistor and a method for manufacturing the same.

BACKGROUND ART

A chip resistor has a pair of electrodes, a resistor substance, and an insulating film. The pair of electrodes containing silver as a main component are formed on a single surface of an insulating substrate. The resistor substance is formed on the single surface of the insulating substrate to make contact with both of the pair of electrodes. The insulating film covers the resistor substance while keeping parts of the pair of electrodes exposed. As to the chip resistor, sulfurization of the pair of electrodes has been regarded as a problem. It is because sulfurization of the pair of electrodes may likely lead to conduction failure or disconnection.

To solve this problem, for example, there has been proposed a technique in which a metal material containing silver and palladium is used as the metal material of the pair of electrodes to thereby suppress sulfurization of the pair of electrodes (see Patent Literature 1).

CITATION LIST

Patent Literature

Patent Literature 1: JP-A-2008-300607

SUMMARY OF INVENTION

Technical Problem

However, when the metal material containing silver and palladium does not have a large content of palladium, it is difficult to obtain a sulfurization resistance effect. Therefore, in the case where, for example, the electrodes are made of a silver-palladium-based material containing 10 weight % or more of palladium, the electrodes become higher in specific resistance than silver electrodes not containing palladium. When a resistance value of the chip resistor is sufficiently high, the difference in specific resistance seldom becomes a problem. On the other hand, when the resistance value of the chip resistor is very low, the difference in specific resistance may become a problem in a trimming step in which trimming is performed while measurement probe electrodes are brought into contact with the pair of electrodes to measure the resistance value in a chip resistor manufacturing process. For example, resistance values of the electrodes from positions where the probe electrodes make contact with the electrodes up to a resistor element formed between the electrodes are added to an original resistance value of the resistor element formed between the electrodes. Therefore, when there is a variation in an interval between the pair of measurement probe electrodes used for measuring the resistance value of the resistor element, the variation in the interval between the probe electrodes has an unignorable influence. In addition, contact resistances generated when the probe electrodes are brought into contact with the pair of electrodes also have an influence on the resistance values of the pair of electrodes high in specific resistance. Because of these influences, it is extremely difficult to stably measure the resistance value.

Therefore, an object of the invention is to provide a chip resistor whose resistance value can be adjusted with high accuracy while maintaining high sulfurization resistance of electrodes of the chip resistor even in the case where the resistance value of the chip resistor is low, and a method for manufacturing this chip resistor.

Solution to Problem

In order to achieve the aforementioned object, the invention provides a chip resistor including: an insulating substrate; a pair of electrodes that are formed on a single surface of the insulating substrate; a resistor substance that is formed on the single surface of the insulating substrate to make contact with both of the pair of electrodes; and an insulating film that covers the resistor substance and partially covers the pair of electrodes; wherein:

each of the pair of electrodes is configured in the following (1) to (5) points:

(1) the electrode has a main electrode layer and an auxiliary electrode layer, the main electrode layer containing silver as a main metal component and 10 weight % or more of palladium as another metal component, the auxiliary electrode layer being lower in specific resistance than the main electrode layer;

(2) the electrode has a laminated part in which the auxiliary electrode layer and the main electrode layer are sequentially laminated in the named order on the single surface of the insulating substrate;

(3) a part of the laminated part is covered with the insulating film on a near side to the resistor substance;

(4) the electrode has an exposed part of the auxiliary electrode layer in which apart of the auxiliary electrode layer is not covered with the main electrode layer on a far side from the resistor substance and which is not covered with the insulating film; and (5) the electrode has parts in which the laminated part extends from the near side to the far side with respect to the resistor substance.

Here, the auxiliary electrode layer may contain 95 weight % or more of silver as a metal component.

In order to achieve the aforementioned object, the invention provides a method for manufacturing a chip resistor, the chip resistor including: an insulating substrate; a pair of electrodes that are formed on a single surface of the insulating substrate; a resistor substance that is formed on the single surface of the insulating substrate to make contact with both of the pair of electrodes; and an insulating film that covers the resistor substance and partially covers the pair of electrodes; wherein: each of the pair of electrodes has a main electrode layer and an auxiliary electrode layer, the main electrode layer containing silver as a main metal component and 10 weight % or more of palladium as another metal component, the auxiliary electrode layer being lower in specific resistance than the main electrode layer; each of the pair of electrodes has a laminated part in which the auxiliary electrode layer and the main electrode layer are sequentially laminated in the named order on the single surface of the insulating substrate; a part of the laminated part is covered with the insulating film on a near side to the resistor substance; each of the pair of electrodes has an exposed part of the auxiliary electrode layer in which a part of the auxiliary electrode layer is not covered with the main electrode layer on a far side from the resistor substance and which is not covered with the insulating film, and each of the pair of electrodes has parts in which the laminated part extends from the near side to the far side with respect to the resistor substance; and a resistor element is constituted by the pair of electrodes and the resistor substance; the method including: a trimming step of adjusting a resistance value of the resistor element; wherein: the trimming step is a step in which while a resistance value between the pair of electrodes is measured by probe electrodes, a groove is formed in the resistor substance until the resistance value between the pair of electrodes reaches a target resistance value; and the probe electrodes are made to abut against the exposed parts of the auxiliary electrode layers during the trimming step.

Here, the method for manufacturing a chip resistor may further include: a step of managing a plurality of the chip resistors by lots and forming a pair of external electrode layers after the trimming step to cover the pair of electrodes respectively; wherein: a first average value of resistance values of the resistor elements obtained by the trimming step is calculated for each of the lots; each of the resistance values of the resistor elements after the step of forming the external electrode layers is measured as a resistance value between the pair of external electrode layers, and a second average value of the measured values is calculated for each of the lots; and based a difference between the first average value and the second average value in one and the same lot, adjustment of the resistance value of the resistor element is corrected during the trimming step of each of the chip resistors of another lot.

Advantageous Effects of Invention

According to the invention, it is possible to provide a chip resistor whose resistance value can be adjusted with high accuracy while maintaining high sulfurization resistance of electrodes of the chip resistor even in the case where the resistance value of the chip resistor is low, and a method for manufacturing this chip resistor.

DESCRIPTION OF EMBODIMENT

A chip resistor and a method for manufacturing the same according to an embodiment of the invention will be described below with reference to the drawings.

(Configuration of Chip Resistor According to Embodiment of the Invention)

Figure 1:
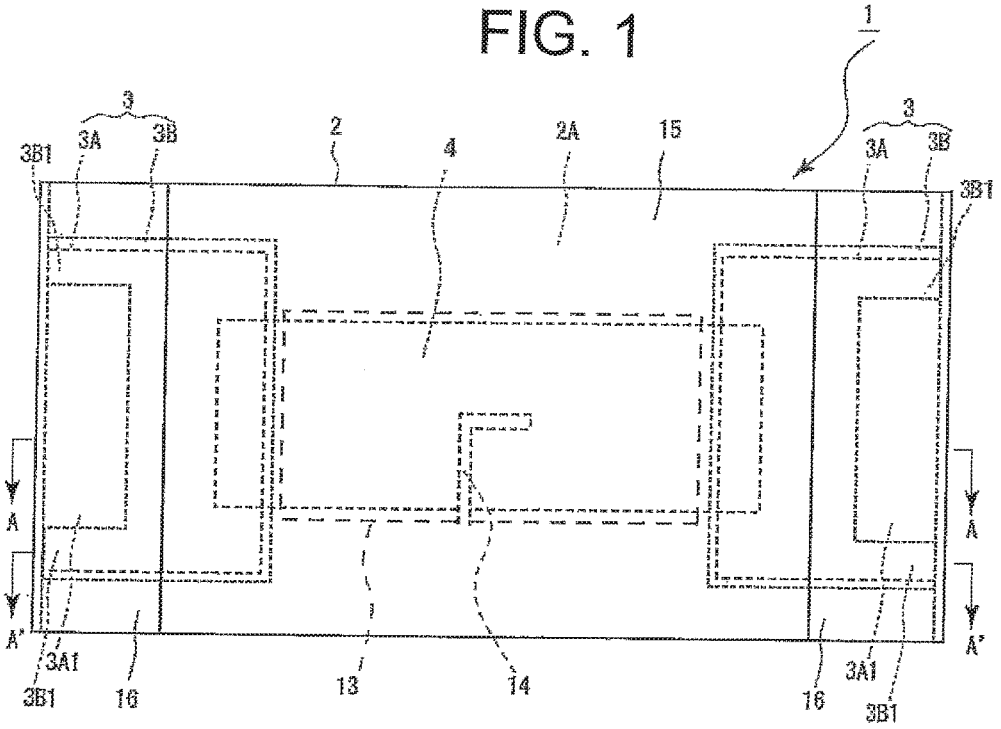
FIG. 1 A plan view of a chip resistor according to an embodiment of the invention.
Figure 2:
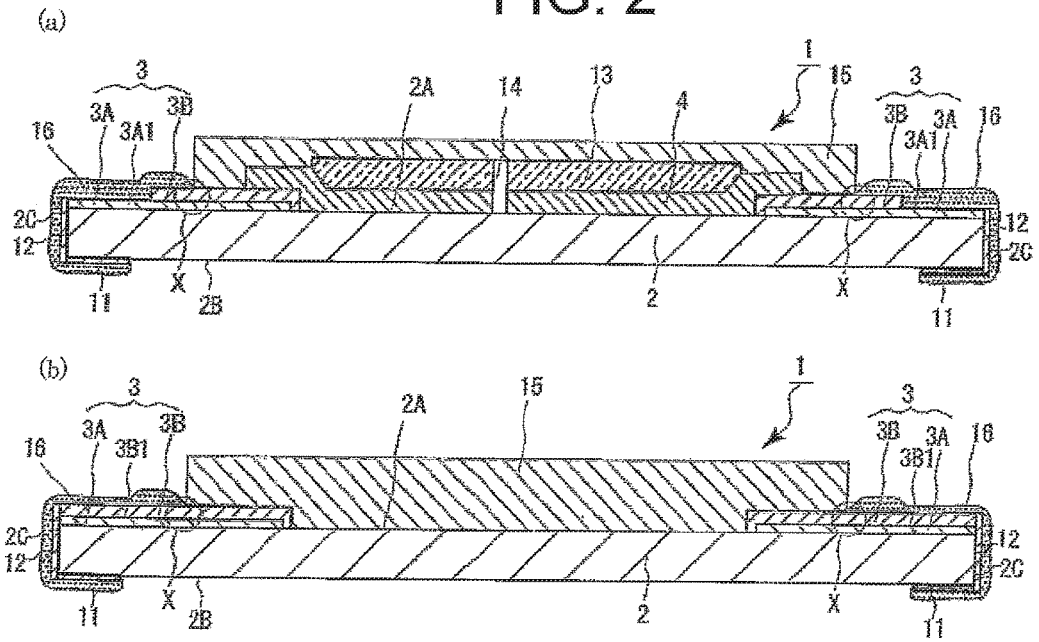
FIG. 2 (*a*) is a sectional view taken along the line A-A of FIG. 1, and (*b*) is a sectional view taken along the line A'-A' of FIG. 1.

FIG. 1 is a plan view of a chip resistor according to an embodiment of the invention. FIG. 2 (*a*) is a sectional view taken along the line A-A of FIG. 1. FIG. 2(*b*) is a sectional view taken along the line A'-A' of FIG. 1. The chip resistor 1 has an insulating substrate 2, a pair of electrodes 3, 3, a resistor substance 4, and an insulating film (an overcoat 15 which will be described later). The pair of electrodes 3, 3 are formed on an upper surface 2A of the insulating substrate 2. The resistor substance 4 containing ruthenium tetroxide as a main component is formed to make contact with both of the pair of electrodes 3, 3. The insulating film covers the resistor substance 4 and covers parts of the pair of electrodes 3, 3.

Each of the pair of electrodes 3, 3 has an auxiliary electrode layer 3A and a main electrode layer 3B. The auxiliary electrode layer 3A is formed into a rectangular shape in plan view. The main electrode layer 3B is higher in sulfurization resistance and higher in specific resistance than the auxiliary electrode layer 3A. The main electrode layer 3B is formed into a U-shape in plan view. Incidentally, the auxiliary electrode layer 3A contains silver as a metal component. The main electrode layer 3B contains 20 weight % of palladium, 5 weight % of gold, and the balance silver as metal components. In addition, each of the pair of electrodes 3, 3 has a part in which the auxiliary electrode layer 3A and the main electrode layer 3B are sequentially laminated in the named order on the upper surface 2A of the insulating substrate 2. In addition, a part of the laminated part in each of the pair of electrodes 3, 3 is covered with the insulating film on a near side to the resistor substance 4. In addition, each of the pair of electrodes 3, 3 has an exposed part 3A1 of the auxiliary electrode layer 3A in which a part of the auxiliary electrode layer 3A is not covered with the main electrode layer 3B on a far side from the resistor substance 4. In addition, each of the pair of electrodes 3, 3 has extending parts 3B1 as parts in which the laminated part extends from the near side to the far side with respect to the resistor substance 4.

In addition, a pair of back electrodes 11, 11 are formed in positions corresponding to the pair of electrodes 3, 3 on a back surface 2B of the insulating substrate 2. End surface electrodes 12, 12 are formed on end surfaces 2C, 2C which connect the front surface 2A and the back surface 2B of the insulating substrate 2 to each other so that the end surface electrodes 12, 12 can connect the pair of electrodes 3, 3 and the pair of back electrodes 11, 11 to each other respectively.

In addition, a protective coating 13 which is made of glass is formed on the resistor substance 4 to protect the resistor substance 4 during trimming which will be described later. A trimming groove 14 used for adjusting the resistance value of the chip resistor 1 is formed in the resistor substance 4 and the protective coating 13. The overcoat 15 (insulating film) made of an epoxy resin is formed to cover parts of the pair of electrodes 3, 3, the resistor substance 4 and the protective coating 13. Further, plating layers 16, 16 (external electrode layers) are formed on front surfaces of parts of the pair of electrodes 3, 3 not covered with the overcoat 15, front surfaces of the end surface electrodes 12, 12, and front surfaces of the back electrodes 11, 11. Each of the plating layers 16, 16 includes a nickel layer and a solder layer formed in the named order.

(Method for Manufacturing Chip Resistor According to Embodiment of the Invention)

Figure 3:
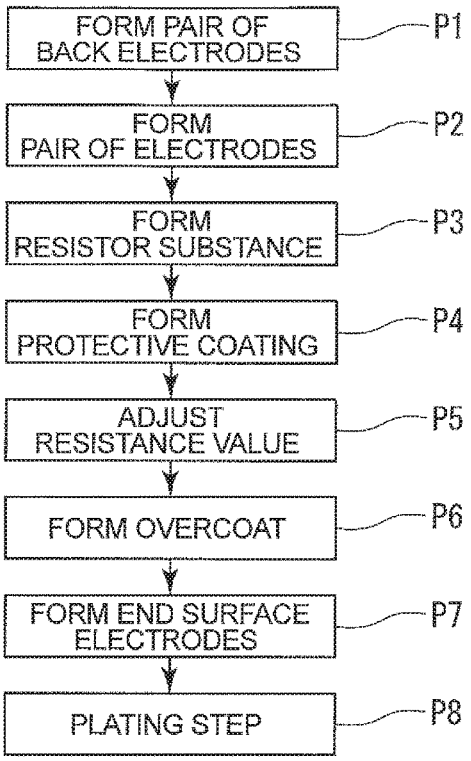
FIG. 3 A flow chart showing a process for manufacturing the chip resistor according to the embodiment of the invention.

FIG. 3 is a flow chart showing a process for manufacturing the chip resistor 1 according to the embodiment of the invention. First, a step P1 is a step of forming a pair of back electrodes 11, 11 on a back surface 2B of an insulating substrate 2. Specifically, a paste containing silver as a metal component is applied onto the back surface 2B of the insulating substrate 2 by screen printing. Then, the insulating substrate 2 is sintered by a sintering furnace. Thus, the pair of back electrodes 11, 11 are formed.

Next, a step P2 is a step of forming a pair of electrodes 3, 3 in positions corresponding to the pair of back electrodes 11, 11 on an upper surface 2A of the insulating substrate 2. Specifically, first, a paste containing silver as a metal component is applied onto the upper surface 2A of the insulating substrate 2 by screen printing. Then, the insulating substrate 2 is sintered by the sintering furnace. Thus, auxiliary electrode layers 3A, 3A are formed. Then, a paste containing silver, palladium (20 weight %) and gold (5 weight %) as metal components is formed by screen printing so as to be superimposed on the auxiliary electrode layers 3A, 3A. Then, the insulating substrate 2 is sintered by the sintering furnace. Thus, main electrode layers 3B, 3B are formed. On this occasion, the respective electrodes (the back electrodes 11, the auxiliary electrode layers 3A, and the main electrode layers 3B) do not have to be sintered separately but may be sintered simultaneously. However, when the auxiliary electrode layers 3A and the main electrode layers 3B are sintered separately, silver of the auxiliary electrode layers 3A can be suppressed from diffusing into the main electrode layers 3B. Accordingly, sulfurization resistance can be improved.

Next, a step P3 is a step of forming a resistor substance 4 to make contact with both of the pair of electrodes 3, 3. Specifically, a paste made of ruthenium tetroxide etc. is applied onto the supper surface 2A of the insulating substrate 2 by screen printing. Then, the insulating substrate 2 is sintered by the sintering furnace. Thus, the resistor substance 4 is formed.

Next, a step P4 is a step of forming a protective coating 13 to cover the resistor substance 4. Specifically, a glass paste is applied onto the upper surface 2A of the insulating substrate 2 by screen printing. Then, the insulating substrate 2 is sintered by the sintering furnace. Thus, the protective coating 13 is formed.

Next, a step P5 is a trimming step of adjusting a resistance value of a resistor element constituted by the pair of electrodes 3, 3 and the resistor substance 4. The resistance value of the resistor element prior to the trimming step is set to be lower than a target resistance value. The trimming step is a step of forming a trimming groove 14 in the resistor substance 4 and the protective coating 13 while measuring a resistance value between the pair of electrodes 3, 3 by probe electrodes (not shown) until the resistance value between the pair of electrodes 3, 3 reaches the target resistance value. The probe electrodes are made to abut against exposed parts 3A1, 3A1 of the auxiliary electrode layers 3A, 3A during the trimming step. In this state, the trimming groove 14 is formed by laser irradiation to thereby narrow a current path of the resistance element gradually. Thus, the resistance value of the resistance element can be increased to reach the target resistance value.

Next, a step P6 is a step of forming an overcoat 15 to cover the resistor substance 4 and the protective coating 13. Specifically, an epoxy resin paste is applied onto the upper surface 2A of the insulating substrate 2 by screen printing. Then, the insulating substrate 2 is thermally cured. Thus, the overcoat 15 is formed.

Next, a step P7 is a step of forming end surface electrodes 12, 12 on end surfaces 2C, 2C which connect the front surface 2A and the back surface 2B of the insulating substrate 2 to each other so that the end surface electrodes 12, 12 can connect the pair of electrodes 3, 3 and the pair of back electrodes 11, 11 to each other respectively. The end surface electrodes 12, 12 are formed out of nickel-chrome by sputtering.

Next, a step P8 is a plating step of forming plating layers 16, 16 (external electrode layers) on front surfaces of parts of the pair of electrodes 3, 3 not covered with the overcoat 15, front surfaces of the end surface electrodes 12, 12, and front surfaces of the back electrodes 11, 11. Each of the plating layers 16, 16 includes a nickel layer and a solder layer formed in the named order. The step P8 is performed by a barrel plating method.

Figure 4:
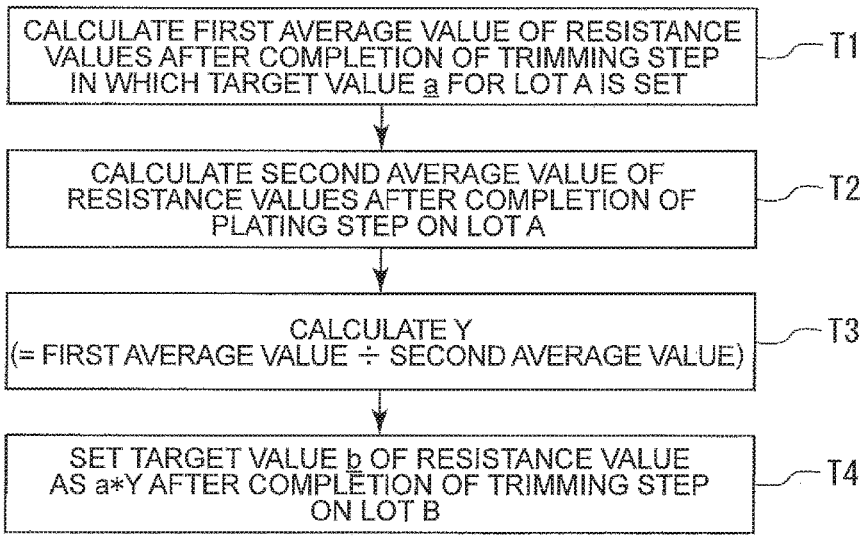
FIG. 4 A flow chart showing a process for adjusting a resistance value in the process for manufacturing the chip resistor according to the embodiment of the invention.

Here, the method for adjusting the resistance value in conjunction with the trimming step P5 will be described in detail. FIG. 4 is a flowchart showing a process for adjusting the resistance value in the process for manufacturing the chip resistor 1 according to the embodiment of the invention. In the process for adjusting the resistance value including the trimming step P5, a plurality of chip resistors 1 are managed by lots. As to a lot A, a first average value of resistance values of resistor elements obtained by the trimming step P5 is calculated (T1). In the trimming step P5, a target value a for adjustment of each resistance value is set at 1Ω which is the resistance value of the chip resistor 1. On this occasion, when trimming is performed in the same conditions, it is unnecessary to measure the resistance values of all the resistance elements of the lot Abut at least some of them may be sampled and measured to measure a first average value.

Each of the resistance values of the resistor elements of the lot A on which the plating step P8 for forming plating layers 16, 16 has been performed is measured as a resistance value between the pair of plating layers 16, 16. The measurement is made while the probe electrodes for measuring the resistance value abut against the plating layers 16, 16. An average value of the measured values is calculated as a second average value. On this occasion, when trimming is performed in the same conditions in the trimming step P5, it is unnecessary to measure the resistance values of all the resistance elements of the lot A but at least some of them may be sampled and measured to measure a second average value.

A coefficient Y of "first average value÷second average value=Y" is calculated (T3). During the trimming step P5 on each chip resistor 1 of another lot B than the lot A, the target value a of the lot A, that is, 1Ω is multiplied by the coefficient Y, and the value obtained and corrected thus is used as a target value b for adjustment of the resistance value (T4).

The aforementioned correction is made on the assumption that each chip resistor 1 of the lot A and each chip resistor 1 of the lot B have the same nominal resistance value. However, similar correction can be made even when, for example, the nominal resistance value of the chip resistor 1 of the lot A and the nominal resistance value of the chip resistor 1 of the lot B are different from each other. When, for example, the nominal resistance value of the lot A is 1Ω and the nominal resistance value of the chip resistor 1 of the lot B is 5Ω, a value obtained by multiplying 5Ω by the coefficient Y can be used as the target value b for the lot B. In order to maintain high accuracy in adjustment of the resistance value, the range of the resistance value which can be corrected in this manner is preferably set as a range in which the nominal resistance value of the lot B is 0.5 times to 5 times as large as the nominal resistance value of the lot A.

(Main Effect Obtained by Embodiment of the Invention)

In the chip resistor 1 according to the embodiment of the invention, each of the pair of electrodes 3, 3 has the exposed part 3A1 of the auxiliary electrode layer 3A. The auxiliary electrode layer 3A is lower in specific resistance than the main electrode layer 3B. Therefore, the trimming step P5 can be performed while the probe electrodes are mad to abut against the exposed parts 3A1. Thus, a variation in an interval between the probe electrodes has little influence on the resistance value to be measured. Therefore, the resistance value can be adjusted with high accuracy even in a chip resistor which is low in resistance value.

In addition, of the pair of electrodes 3, 3 constituting the chip resistor 1, parts most likely to be exposed to sulfide gas such as hydrogen sulfide are gap parts (parts X, X indicated in FIG. 2) between the overcoat 15 which is the insulating film and the external electrode layers. However, the main electrode layers 3B high in sulfurization resistance are disposed on the parts X, X respectively. Therefore, sulfurization resistance of the pair of electrodes 3, 3 can be maintained.

In addition, in each of the pair of the electrodes 3, 3, the laminated part is formed out of the main electrode layer 3B and the auxiliary electrode layer 3A. The laminated part has extending parts 3B1 in which the laminated part extends from the near side to the far side with respect to the resistor substance 4. Then, a current path between the probe electrodes abutting against the exposed parts 3A1, 3A1 respectively is apt to pass through the extending parts 3B1 (the laminated parts where the auxiliary electrode layers 3A and the main electrode layers 3B are superimposed on each other) from the points where the probe electrodes abut against the exposed parts 3A1, 3A1. Incidentally, the laminated parts where the auxiliary electrode layers 3A and the main electrode layers 3B are superimposed on each other are small in specific resistance value correspondingly to large thicknesses of the laminated parts. In addition, the laminated parts are formed to be covered with the insulating film at least partially. Therefore, the resistance value generated when the external electrode layers formed up to the insulating film are formed hardly changes. Accordingly, when the trimming step P5 is performed, the current path between the probe electrodes abutting against the exposed parts 3A1, 3A1 respectively can be made more approximate to a current path formed when the chip resistor 1 is actually used.

In the method for manufacturing the chip resistor 1 according to the embodiment of the invention, the probe electrodes are made to abut against the exposed parts 3A1 of the auxiliary electrode layers 3A lower in specific resistance value than the main electrode layers 3B during the trimming step. Accordingly, a measurement error caused by the contact positions of the probe electrodes hardly occurs and contact resistances in the positions are also reduced. Therefore, it is possible to obtain a more accurate measurement value so that it is possible to adjust the resistance value with high accuracy.

As shown in FIG. 4, in the process of adjusting the resistance value including the trimming step P5, a plurality of chip resistors 1 are managed by lots, and a change in each of resistance values of the chip resistors 1 before or after the step P8 of forming the plating layers 16, 16 in a lot A is reflected on another lot B than the lot A. When the plating layers 16, 16 are formed on the pair of electrodes 3, 3 by the step P8 of forming the plating layers 16, 16, the plating layers 16, 16 are added in the electric conduction path of the parts of the pair of electrodes 3, 3 when the chip resistor 1 is used. Accordingly, the specific resistance value is reduced correspondingly to the increased thickness of the electric conduction path. As a result, the resistance value of the chip resistor 1 is reduced. Therefore, the target resistance value of each chip resistor 1 of the lot B is set to be slightly higher than that of each chip resistor 1 of the lot A in the stage of the trimming step P5 so that correction can be made correspondingly to the reduction in the resistance value of the chip resistor 1 caused by the formation of the plating layers 16, 16.

The configuration of the chip resistor 1 is favorable for a resistor whose resistance value is so low that the specific resistance of the pair of electrodes 3, 3 may be regarded as a problem. For example, it is favorable to use the configuration of the chip resistor 1 particularly for a low resistance resistor whose nominal resistance value is not higher than 1Ω.

(Other Embodiments)

The chip resistor and the method for manufacturing the same according to the aforementioned embodiment of the invention are merely examples of preferable modes for carrying out the invention. However, they are not limited thereto but various modifications can be made without changing the gist of the invention.

Figure 5:
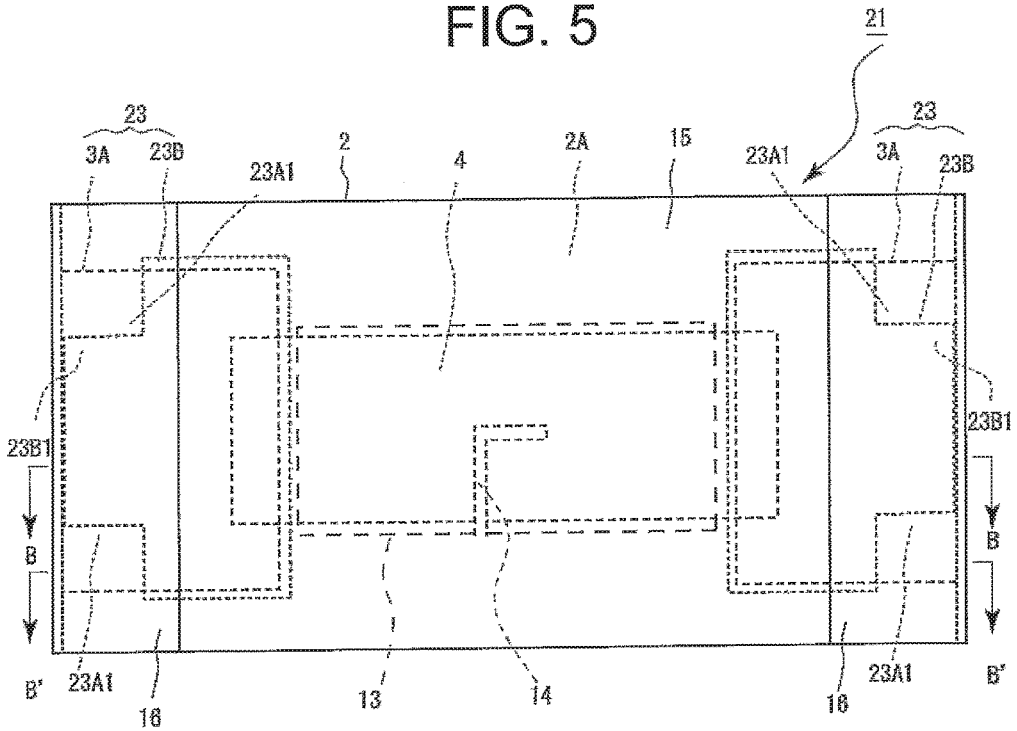
FIG. 5 A plan view of a chip resistor according to a modification of the embodiment of the invention.
Figure 6:
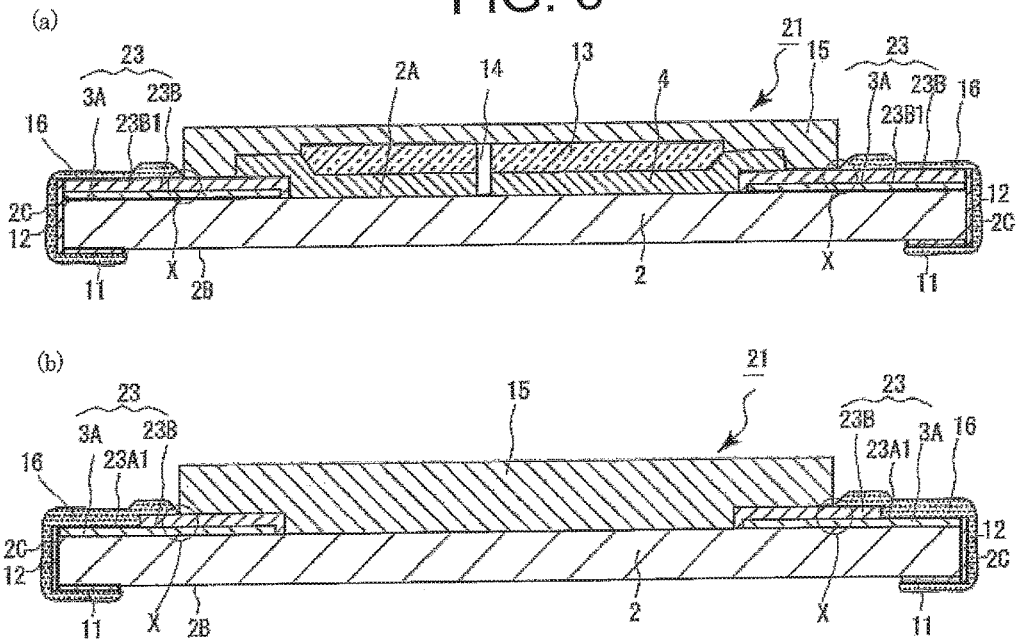
FIG. 6 (*a*) is a sectional view taken along the line B-B of FIG. 5, and (*b*) is a sectional view taken along the line B'-B' of FIG. 5.

For example, each of the pair of electrodes 3, 3 has the auxiliary electrode layer 3A and the main electrode layer 3B. The auxiliary electrode layer 3A is formed into a rectangular shape in plan view. The main electrode layer 3B is formed into a U-shape in plan view. The main electrode layer 3B is higher in sulfurization resistance and higher in specific resistance than the auxiliary electrode layer 3A. However, the planar shape of the auxiliary electrode layer 3A and the planar shape of the main electrode layer 3B can be formed into other shapes. For example, FIG. 5 is a plan view of a chip resistor 21 according to a modification of the embodiment of the invention. FIG. 6(*a*) is a sectional view taken along the line B-B of FIG. 5. FIG. 6(*b*) is a sectional view taken along the line B'-B' of FIG. 5. The chip resistor 21 has the same configuration as the chip resistor 1 except that the shape of the main electrode layers 3B in the chip resistor 1 is changed to the shape of main electrode layers 23B which is a T-shape in plan view. In FIG. 5 and FIG. 6, constituent members of the chip resistor 21 the same as those of the chip resistor 1 will be referred to by the same signs in the chip resistor 1 correspondingly and respectively. Description about the common constituent members between the chip resistor 1 and the chip resistor 21 will be omitted.

In the chip resistor 21, two exposed parts 23A1 of an auxiliary electrode layer 3A are provided for each electrode 23 and located at opposite ends of the electrode 23 in a direction perpendicular to an electric conduction direction so as to interpose an extending part 23B1 therebetween. Therefore, when measurement of a resistance value during a trimming step P5 is performed based on so-called four-terminal measurement, places where probe electrodes abut against can be made clear. It is a matter of course that four-terminal measurement can be also made on the exposed parts 3A1 of the chip resistor 1.

In addition, the auxiliary electrode layer 3A contains silver as a metal component. A main electrode layer 3B has silver as a main metal component, and contains 20 weight % of palladium and 5 weight % of gold as other metal components. However, the material of the auxiliary electrode layer 3A and the material of the main electrode layer 3B are not limited thereto but can be changed suitably. For example, the auxiliary electrode layer 3A may contain any metal component as long as it is lower in specific resistance than the main electrode layer 3B. The auxiliary electrode layer 3A may contain palladium as long as the content of palladium is approximately not higher than 5 weight %. Due to a small amount of palladium contained in the auxiliary electrode layer 3A, diffusion of silver into the resistor substance 4 from the auxiliary electrode layer 3A and an adverse influence of the diffusion of silver on temperature characteristic of the resistor substance 4 can be reduced. In addition, due to the small amount of palladium contained in the auxiliary electrode layer 3A, diffusion of silver into the main electrode layer 3B from the auxiliary electrode layer 3A can be also suppressed. Therefore, sulfurization resistance of the main electrode layer 3B can be prevented from being lowered. In addition, the main electrode layer 3B may contain any metal components as long as it is high in sulfurization resistance. The content of palladium can be set to be not lower than 10 weight %, to be not lower than 20 weight %, or to be not lower than 30 weight %. Further, the main electrode layer 3B does not have to contain gold substantially as a metal component.

In addition, since the pair of back electrodes 11, 11 and the end surface electrodes 12, 12 are not essential constituent members, they can be removed. In this case, the chip resistor 1 can be used as a so-called facedown resistor in which the pair of electrodes 3, 3 are mounted to face a mounting substrate.

Further, the nominal resistance value of the chip resistor 1 is 1Ω. However, the resistance value of the chip resistor 1 may be higher than 1Ω or may be lower than 1Ω. The chip resistor 1 according to the embodiment of the invention is particularly favorable for the case of a low resistance resistor whose nominal resistance value is not higher than 1 Ω.

As shown in FIG. 4, in the process of adjusting the resistance value including the trimming step P5, the plurality of chip resistors 1 are managed by lots, and a change in each of the resistance values of the chip resistors 1 before or after the step P8 of forming the plating layers 16, 16 in the lot A is reflected on another lot B than the lot A. However, it is not always necessary to use the method for adjusting the resistance value as shown in FIG. 4.

Further, during the trimming step P5 on each of the chip resistors 1 of the lot B, the value obtained by multiplying the target value a of the lot A, that is, 1Ω by the coefficient Y (=first average value÷second average value) is used as the target value b for adjustment of the resistance value. In this manner, adjustment of the resistance value is corrected. However, such a correction method may be replaced, for example, by the following method. That is, a value "first average value −second average value" (coefficient Z) is calculated and a value obtained by adding the coefficient Z to the target value a of the lot A, that is, 1Ω is used as the target value b for adjustment of the resistance value. That is, when correction is applied to adjustment of the resistance value of the resistor element based on the difference between the first average value and the second average value during the trimming step P5 on each chip resistor 1 of the lot B, there are lots of choices in the correction method.

REFERENCE SIGNS LIST

1 chip resistor
2 insulating substrate
3 electrode
3A auxiliary electrode layer
3B main electrode layer
3A1, 23A1 exposed part
3B1, 23B1 extending part (part that extends)
4 resistor substance
13 protective coating
15 overcoat (insulating film)
16 plating layer (external electrode layer)
P5 trimming step
P8 plating step (step of forming external electrode layers)

The invention claimed is:

1. A chip resistor comprising:
an insulating substrate;
a pair of electrodes that are formed on a single surface of the insulating substrate;
a resistor substance that is formed on the single surface of the insulating substrate to make contact with both of the pair of electrodes; and
an insulating film that covers the resistor substance and partially covers the pair of electrodes; wherein:
each of the pair of electrodes is configured in the following (1) to (5) points:
(1) the electrode has a main electrode layer and an auxiliary electrode layer, the main electrode layer containing silver as a main metal component and 10 weight % or more of palladium as another metal component, the auxiliary electrode layer being lower in specific resistance than the main electrode layer;
(2) the electrode has a laminated part in which the auxiliary electrode layer and the main electrode layer are sequentially laminated in the named order on the single surface of the insulating substrate;
(3) a part of the laminated part is covered with the insulating film on a near side to the resistor substance;
(4) the electrode has an exposed part of the auxiliary electrode layer in which a part of the auxiliary electrode layer is not covered with the main electrode layer on a far side from the resistor substance and which is not covered with the insulating film; and
(5) the electrode has parts in which the laminated part extends from the near side to the far side with respect to the resistor substance.

2. A chip resistor according to claim 1, wherein:
the auxiliary electrode layer contains 95 weight % or more of silver as a metal component.

3. A method for manufacturing a chip resistor, the chip resistor including:
an insulating substrate;
a pair of electrodes that are formed on a single surface of the insulating substrate;
a resistor substance that is formed on the single surface of the insulating substrate to make contact with both of the pair of electrodes; and
an insulating film that covers the resistor substance and partially covers the pair of electrodes; wherein:
each of the pair of electrodes has a main electrode layer and an auxiliary electrode layer, the main electrode layer containing silver as a main metal component and 10 weight % or more of palladium as another metal component, the auxiliary electrode layer being lower in specific resistance than the main electrode layer;
each of the pair of electrodes has a laminated part in which the auxiliary electrode layer and the main electrode layer are sequentially laminated in the named order on the single surface of the insulating substrate;
a part of the laminated part is covered with the insulating film on a near side to the resistor substance;
each of the pair of electrodes has an exposed part of the auxiliary electrode layer in which a part of the auxiliary electrode layer is not covered with the main electrode layer on a far side from the resistor substance and which is not covered with the insulating film, and each of the pair of electrodes has parts in which the laminated part extends from the near side to the far side with respect to the resistor substance; and a resistor element is constituted by the pair of electrodes and the resistor substance;

the method comprising:

a trimming step of adjusting a resistance value of the resistor element; wherein:

the trimming step is a step in which while a resistance value between the pair of electrodes is measured by probe electrodes, a groove is formed in the resistor substance until the resistance value between the pair of electrodes reaches a target resistance value; and the probe electrodes are made to abut against the exposed parts of the auxiliary electrode layers during the trimming step.

4. A method for manufacturing a chip resistor according to claim 3, further comprising:

a step of managing a plurality of the chip resistors by lots and forming a pair of external electrode layers after the trimming step to cover the pair of electrodes respectively; wherein:

a first average value of resistance values of the resistor elements obtained by the trimming step is calculated for each of the lots;

each of the resistance values of the resistor elements after the step of forming the external electrode layers is measured as a resistance value between the pair of external electrode layers, and a second average value of the measured values is calculated for each of the lots; and based on a difference between the first average value and the second average value in one and the same lot, adjustment of the resistance value of the resistor element is corrected during the trimming step of each of the chip resistors of another lot.

* * * * *